United States Patent [19]

Reimer

[11] Patent Number: 5,018,631

[45] Date of Patent: May 28, 1991

[54] HOIST DEVICE FOR A LOAD HANGING ON HOIST ROPES, IN PARTICULAR A CONTAINER-CRANE

[75] Inventor: Hans-Jürgen Reimer, Partenstein, Fed. Rep. of Germany

[73] Assignee: Mannesmann Rexroth GmbH, Lohr/Main, Fed. Rep. of Germany

[21] Appl. No.: 402,873

[22] Filed: Sep. 5, 1989

[30] Foreign Application Priority Data

Sep. 7, 1988 [DE] Fed. Rep. of Germany ..... 3830429

[51] Int. Cl.[5] ..... B66C 23/00

[52] U.S. Cl. ..... 212/250; 212/148; 294/81.4

[58] Field of Search ..... 212/250, 146, 147, 148, 212/156, 212; 294/81.4

[56] References Cited

U.S. PATENT DOCUMENTS

| | | | |
|---|---|---|---|
| 3,254,775 | 6/1966 | Bevard et al. | 212/147 |
| 3,653,518 | 4/1972 | Polen | 294/81.4 |
| 3,675,960 | 7/1972 | Mangold | 294/81.4 |
| 3,786,935 | 1/1974 | Vlazny et al. | 212/146 |
| 3,828,940 | 8/1974 | Cooper | 294/81.4 |
| 4,563,030 | 1/1986 | Makin | 212/146 |
| 4,784,420 | 11/1988 | Makino et al. | 294/81.4 |

FOREIGN PATENT DOCUMENTS

| | | | |
|---|---|---|---|
| 2214348 | 10/1973 | Fed. Rep. of Germany | 212/148 |
| 3126206 | 1/1983 | Fed. Rep. of Germany | 212/147 |
| 2713 | 1/1981 | Japan | 212/147 |
| 6959 | 2/1981 | Japan | 212/147 |
| 24786 | 5/1982 | Japan | 212/147 |
| 82986 | 5/1983 | Japan | 212/147 |
| 1370050 | 1/1988 | U.S.S.R. | 212/147 |

*Primary Examiner*—Sherman Basinger
*Assistant Examiner*—Thomas J. Brahan
*Attorney, Agent, or Firm*—Harness, Dickey & Pierce

[57] ABSTRACT

A container is suspended from four hoist ropes. One end of each rope is wound on a drum to be driven in either direction to hoist or lower the container. The second end of each rope is connected to a double acting hydraulic cylinder. The cylinders are controlled by a valve system to dampen swaying of the load to reset the ropes and for skewing, trimming and listing the load.

9 Claims, 2 Drawing Sheets

HOIST DEVICE FOR A LOAD HANGING ON HOIST ROPES, IN PARTICULAR A CONTAINER-CRANE

The invention relates to a hoist device for a load hanging on a plurality of hoist ropes, in particular a container-crane.

BACKGROUND OF THE INVENTION

FIG. 1 shows schematically the lay-out of the ropes of a container-crane. The top of a container is engaged by a spreader at which four corners a pulley each is mounted for accommodating a hoist rope of which the first end is wound on a motor driven drum, while the second rope end is mounted stationary. All the ropes run over pulleys mounted on a travelling crane trolley. By driving the drums in either direction the load is hoisted and lowered.

SUMMARY OF THE INVENTION

Long rope lengths, high travelling speeds of the trolley and of the drums result in an undesired swaying of the unit composed of spreader and container. In the swaying action the ropes swinging into the swaying direction are tensioned and the other ropes are unloaded. It often happens that the containers are loaded unevenly so that the swaying is amplified or becomes irregular. It is an object of the present invention to provide for a sway dampening system.

Furthermore, undue high tensions may occur when the container or spreader becomes incidentally hooked to the boat. An overload safety device may terminate the lifting as soon as possible, but very high forces may occur in the ropes and the mechanics until the drive means stop. It is an further object of the invention to overcome this problem.

It is a still further object to provide a positioning system which allows to align a container to the touch-down surface in case the container is lop-sided or is skewed with respect to its vertical axis. Conventional systems need a very high mechanical expenditure to provide for a remedy.

The problems mentioned before hold true for a container-crane, however, basically the same problems are encountered where loads are suspended on a plurality of hoist ropes in a simular manner shown in FIG. 1. Therefore the invention is not limited to a four-corner-suspension of a container-crane as shown in FIG. 1.

The present invention provides a device which overcomes many of the problems associated with hoisting means of the type discussed before. The hydraulic system provided by the invention allows to accurately position a load with respect to the touch-down surface and to effectively dampen the load swaying.

According to the invention the hydraulic system provides for a compensation of different lengths of ropes, further the swaying of the load is dampened, the load may be easily positioned and in case of an accident the rope tension is effectively decreased before the overload safety device is activated. According to the invention there is provided a hydraulic system having a variety of functions which are obtained by connecting each hoist rope to a hydraulic cylinder which is individually or groupwise controlled.

Additional advantages and benefits of the present invention, in particular of a valve arrangement according to the present invention will become apparent upon a reading of the description of the preferred embodiment taking in conjunction with the accompaning drawing.

DETAILED DESCRIPTION

Figure 1:
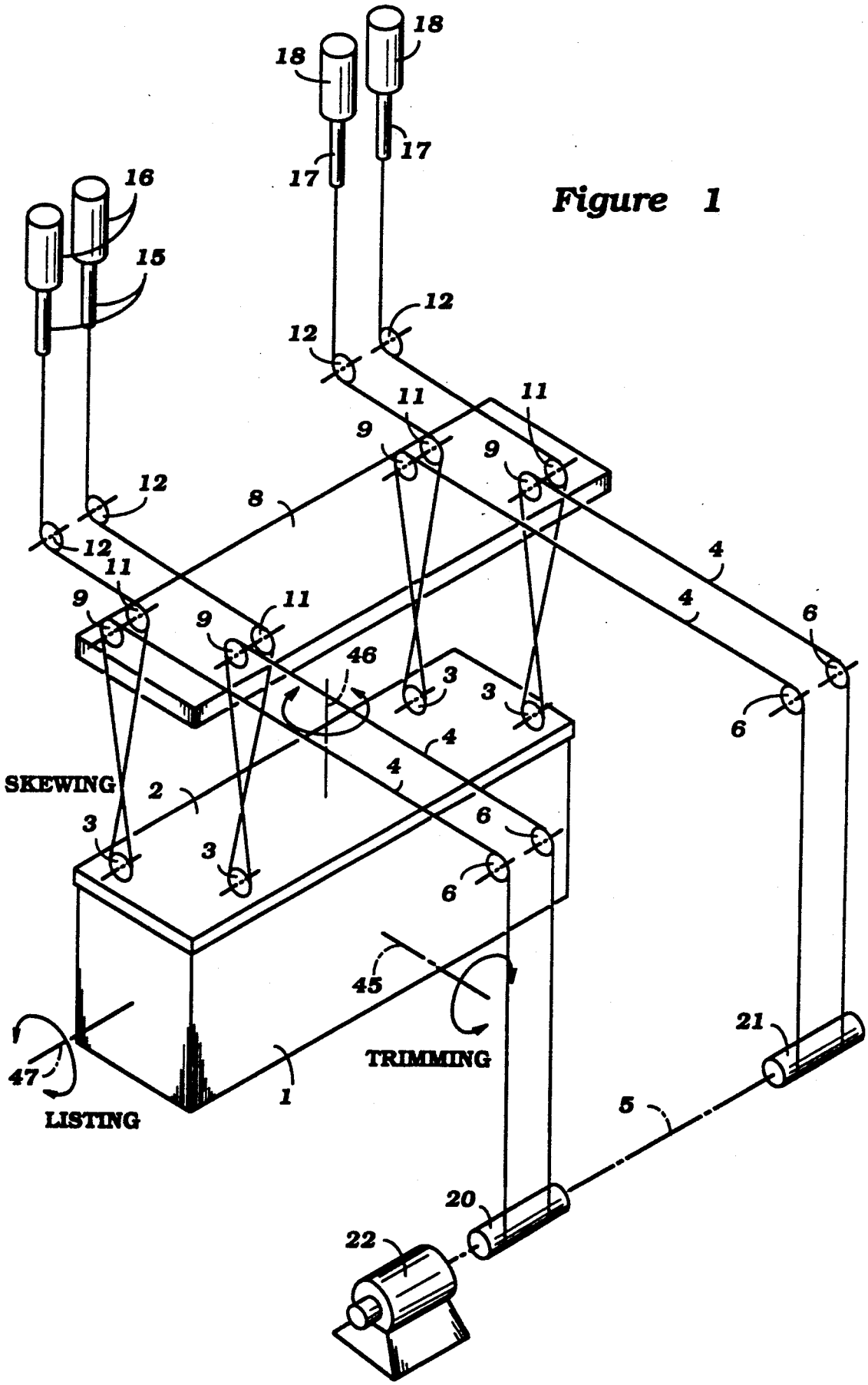
FIG. 1 is a schematic view of the rope-lay-out for a container-crane.

FIG. 1 shows a container 1 and a spreader 2 at top of the container. Each corner of the spreader 2 is provided with a pulley 3.

Each pulley 3 accomodates a hoist rope 4 in a pulley block system. Accordingly each hoist rope 4 runs from a hoist mechanism 5 over a stationary pulley 6 to a pulley 9 rotatably mounted on a trolley 8, then downwardly over the pulley 3 and upwardly back to the trolley 8 and over a further pulley 11 and from there over a stationary pulley 12 which is mounted at the end of the crane boom and to one of the piston rods 15 of hydraulic cylinders 16 or to one of the piston rods 17 of hydraulic cylinders 18 which are mounted stationary.

The trolley 8 travels along the crane boom. The drive motor for the trolley is not shown.

The lay-out of the ropes is in a pair of groups, i.e. a left group incorporating the hoist ropes 4 which are wound on a drum 20 and a right group with the ropes 4 wound on a further drum 21. Both drums 20 and 21 are driven by a common motor 22 to hoist and lower the container 1. The hydraulic cylinders 16 belong to the left group and the hydraulic cylinders 18 to the right group. The ends of the ropes 4 of the right group are fixed to the piston rods 17.

Figure 2:
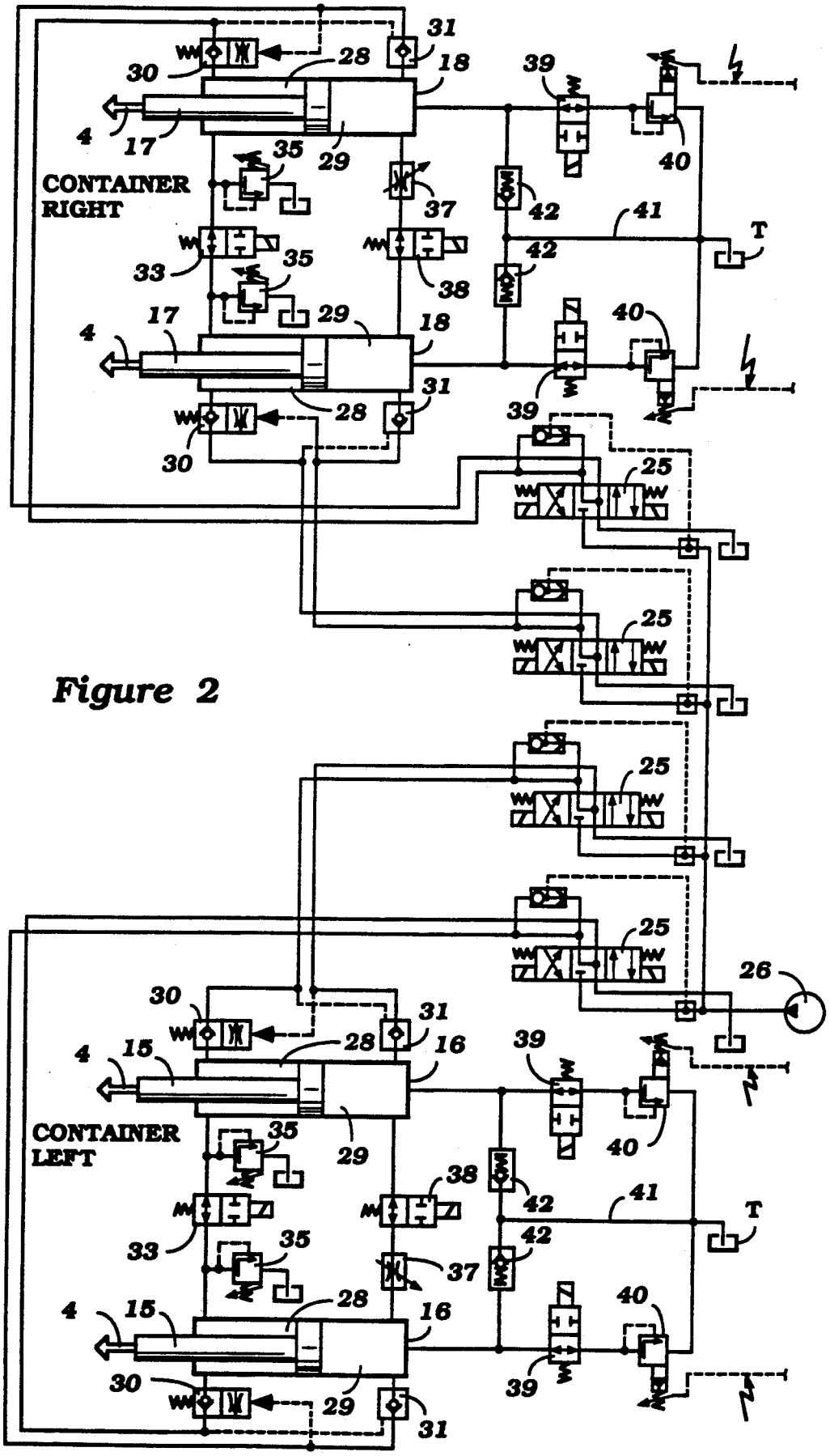
FIG. 2 is a hydraulic circuitry including a valve arrangement for controlling the hydraulic cylinders.

FIG. 2 shows a control block including a plurality of directional valves each provided for one of the hydraulic cylinders. Accordingly each cylinder may be connected by means of one of the directional valves to a pressure source 26 or, respectively, to a reservoir T to supply pressurized fluid either to the piston rod sided cylinder chamber 28 or to the piston sided cylinder chamber 29, while the other cylinder chamber each is connected to the reservoir. As known a combined load holding and brake-valve 30 is provided piston rod sided and a blocking valve 31 is provided piston sided. In the neutral position shown the control conduits for both valves 30 and 31 are connected through its directional valve in the block 25 to the reservoir so that the valves are closed and thus the piston and the hoist rope 4 are hydraulicly blocked. When the directional valve is displaced from its neutral position to an operating position the valves 30 and 31 open in response to the travel direction of the cylinder to provide for the fluid connection between the cylinder, the pressure source, or respectively the reservoir to which the fluid displaced returns. In the pump-line to each directional valve a pressure compensating valve is provided which is known per se so that details are not explained.

The above is true for each of the cylinders 16 and 18. The same is true for the description of the drawings for the arrangement of the cylinders 16 and 18 in pairs, each pair defining a group. Accordingly the piston rod sided chambers 28 of the cylinders 16 and 18 of each group are connected to each other through a balance valve 33 to obtain in the cylinder chambers 28 a balance of fluid. The balance valve 33 can be activated to take a blocked position. A pressure relief valve 35 is connected to each chamber 28.

The piston sided chambers 29 in each group are connected to each other through a throttle 37 and a balance valve 38.

Further a pressure relief valve 40 is connected to each piston sided chamber 29 through a shut-off valve 39. The down-stream-side of each pressure relief valve 40 is connected to the reservoir T and through a conduit 41 and a checkvalve 42 to the piston-sided chamber 29 of the other cylinder in the same group.

The pressure relief valves 40 are electrically adjustable. A weighing device not shown generates an electrical signal each representing the load on the right and left side of the container which loads may be nonuniform, that signal adjusting the pressure at which the corresponding valve opens. The adjusted pressure is thus depending on the weight of the load.

The operation is as follows:

In the neutral position the cylinders 16 and 18 approximately stay half way. Due to differing rope length a difference in stroke may be present. When the differences in length between the four hoist ropes 4 are too large, the strokes of the cylinders cannot be used at an optimum. Accordingly the length of one or the other rope 4 must be reset on the drum 2o or 21. Each cylinder is contolled by its directional valve in the block 25 to compensate for different lengths of the ropes.

When the load performs a swaying action it was explained above that one of the ropes 4 each in the right or left group is tensioned and the other is unloaded. For example, a tensioned rope pulls the piston rod 17 out of the upper cylinder 18 and thus looses. tension; the fluid displaced from this cylinder chamber 28 flows through the valve 33 to the chamber 28 of the lower cylinder 18 of this group thereby tensioning the rope 4 thereof which had been somewhat unloaded in swaying.

By this retensioning of the lower cylinder 18 the fluid from chamber 29 is displaced, the pressure relief valve 40 opens and the displaced fluid flows to the reservoir T. The pressure relief valve 40 thus defines a hydraulic resistance to affect the dampening of swaying. Since the pressure relief valve 40 is adjusted to a predetermined pressure in response to the load the valve automatically provides an optimum dampening grade. The swaying energy is thus consumed by the pressure relief valve 40.

To prevent a vacuum condition in the chamber 29 of the upper cylinder 18 when the piston rod 17 pulls outwardly the fluid flowing through the pressure relief valve 40 may return through the conduit 41 and the upper check-valve 42 opening in this flowing direction to the cylinder chamber 29 of the upper cylinder 18. Any volume of fluid needed in addition is taken from the reservoir T.

The dampening operation above referred to takes place alternatively in each of the right and left group until the container swaying comes to a stop.

During the dampening operation the balance valve 38 is blocked. After the dampening is terminated the balance valve 38 is switched off and returns in the position shown in which the piston- sided chambers 29 of both cylinders 18 are connected to each other to allow for a balance of fluid after the dampening is terminated.

To block the dampening operation both the valves 39 are in blocked position.

The dampening operation takes place with a relatively high speed. This results in a relatively large volume of fluid to be displaced which is controlled by valves operating under logic conditions (open-closed). Dampening is a passive operation which means that the pump 26 must not run.

In case an undue high rope tension occurs the operating pressure in the chamber 28 of the correlated cylinder increases until the spring force of the pressure relief valve 35 is overcome. This valve opens and the piston rod 17 may be pulled out until the end position is reached where dampening means are provided to prevent an impact. Accordingly a protective device is activated before an overload safety deprotective stops driving the drums when a rope tension too high occurs. This means that in the very short period of time between activating the overload safety device and stopping the drive motor 22 the ropes and the mechanical devices are protected by the rapid operation of the pressure relief valves 35. Through the check-valves 42 any fluid needed flows from the reservoir to the chambers 29 the valves 42 thus acting as empty-cavitation valves. This protective device is operative at any time and the pump 26 may be in the shut-off condition.

By operating the valves in the block 25 the rope length may be adjusted to position the container 1 around three axis with respect to the touch-down top face of the container.

For this operation the pump 26 must be operative.

Trimming the container around the transversal axis 45 shown in FIG. 1 allows to lift the right side of the container and to lower the left side of the container, for example.

Accordingly the valves are positioned to pull in both right cylinders 18 and to extend both left cylinders 16. In this operation the cylinders belonging to the right or respectively left group are connected to each other through the balance valves 33 and 38.

For skewing around the vertical axis 46 a right and a left cylinder each extend in parallel and the other cylinders pull in. Accordingly the pairs of cylinders must be operated separately.

Finally the container may be listed about its longitudinal axis 47 for example to lift the container at the front side and lowering the container at the rear side. Again right and left cylinder each cooperate and the pairs of cylinders in each group are operated individually.

The load holding valves 30 or brake-valves switched over into their throttling position allow a smooth, soft load responsive lowering of the ropes while performing the positioning operations.

Each directional valve of the block 25 cooperates with an individual pressure compensator so that the adjusting speed of each cylinder is independant of the load acting thereon

I claim:

1. A hoist device for a load suspended from four hoist ropes, in particular a container-crane, each rope having a first end and a second end, comprising drums, driving means and a plurality of crane-sided and load-sided pulleys, the first end of each rope being wound up and off a driven drum, characterized in that four hydraulic cylinders arrayed in pairs are provided one between the second end of each rope and a crane-sided fixed point, each cylinder including a pair of cylinder chambers and that a valve system is provided to selectively connect said cylinder chambers to a pressure source through individual directional valves or to a reservoir through a hydraulic resistance and to selectively connect said cylinders of each pair to each other for compensating different rope lengths and rope tension forces for positioning the load.

2. The hoist device of claim 1, wherein said second end of each rope is secured to a piston rod of one of the hydraulic cylinders, characterized in that the piston-rod-sided chambers of each cylinder pair are connected to each other and that the piston-sided cylinder chambers of each cylinder pair are connected through a pressure relief valve to the reservoir and to each other through a check-valve opening in the flowing direction of the fluid.

3. The hoist device of claim 2, wherein the pressure relief valve is adjustable in response to the weight of the load.

4. The hoist device of claim 2, wherein the piston-sided cylinder chambers of each cylinder pair are connected to each other through a throttle and a balance valve.

5. The hoist device of claim 2, wherein a shut-off valve is provided between each of the piston-sided cylinder chambers and the respective pressure relief valve.

6. The hoist device of claim 2, wherein a pressure relief valve is connected to each piston rod-sided cylinder chamber which valve opens in response to the rope tension exceeding a predetermined value.

7. The hoist device of claim 1, wherein each cylinder is connected through a directional valve to a pressure source or, respectively, to the reservoir to reduce and/or to extend each of the ropes by controlling said cylinders individually or in groups.

8. The hoist device of claim 7, wherein the hydraulic cylinders are operative in pairs corresponding to the suspension points of the load on the ropes and the travelling direction of the load.

9. The hoist device of claim 8, wherein the piston rod chambers of each cylinder pair are connected to each other and the fluid displaced from one of the cylinders flows over to the adjacent cylinder through a pressure relief valve.

* * * * *